United States Patent [19]

Reuland

[11] 4,043,454

[45] Aug. 23, 1977

[54] METHOD AND APPARATUS FOR PRODUCING AND CONTROLLING THE PRODUCTION OF COMPOSITE FILTER PLUGS

[75] Inventor: Joachim Reuland, Neu Bornsen, Germany

[73] Assignee: Hauni-Werke Korber & Co. KG, Hamburg, Germany

[21] Appl. No.: 627,656

[22] Filed: Oct. 31, 1975

[30] Foreign Application Priority Data

Nov. 22, 1974 Germany ..... 2455271

[51] Int. Cl.[2] ..... B07C 5/344

[52] U.S. Cl. ..... 209/81 R; 209/73; 324/61 R; 93/77 FT

[58] Field of Search ..... 209/72, 73, 81 R; 324/61 R; 317/246; 93/1 C, 77 FT; 131/29, 46

[56] References Cited

U.S. PATENT DOCUMENTS

| | | | |
|---|---|---|---|
| 2,357,801 | 9/1944 | Arelt | 209/81 R |
| 3,001,648 | 9/1961 | Molins et al. | 209/81 R |
| 3,399,606 | 9/1968 | Molins | 93/77 FT X |
| 3,696,299 | 10/1972 | Pullman et al. | 324/61 R |

FOREIGN PATENT DOCUMENTS

| | | | |
|---|---|---|---|
| 2,145,375 | 3/1973 | Germany | 93/77 FT |

*Primary Examiner*—Robert B. Reeves
*Assistant Examiner*—Joseph J. Rolla
*Attorney, Agent, or Firm*—Peter K. Kontler; John Kurucz

[57] ABSTRACT

The operation of apparatus for the production of composite filter plugs is controlled by a circuit which employs one or more capacitive detectors mounted adjacent to the path of filter rod sections and transmitting signals which are indicative of the passage of filter rod sections of different types and/or the absence of filter rod sections. The control circuit regulates the speed of the main prime mover which is directly coupled to a cutoff for subdividing the filter rod into composite filter plugs, the speed ratio of a transmission which can drive the conveyors of the apparatus at any one of several speeds, an ejector which can segregate defective filter plugs from satisfactory filter plugs, and the circuit for arresting the main prime mover.

26 Claims, 15 Drawing Figures

Fig.3a
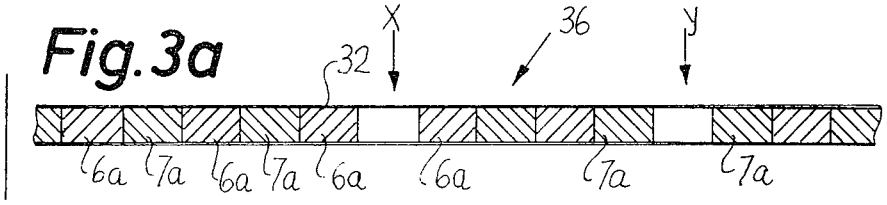
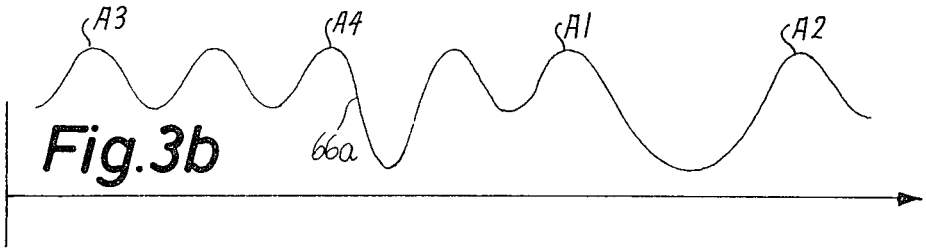
Fig.3b
Fig.3c
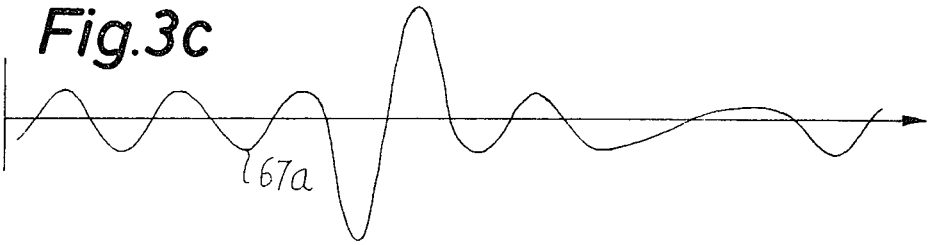
Fig.3d
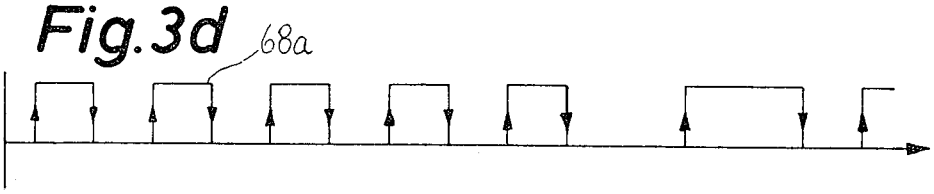
Fig.3e
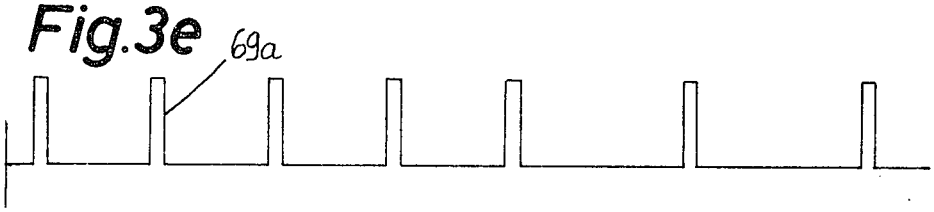
Fig.3f
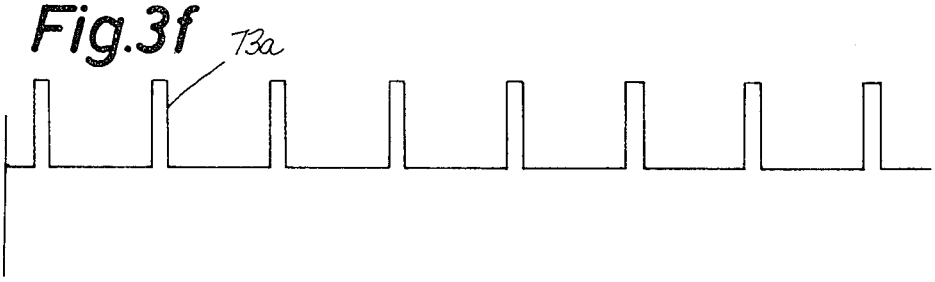

X
36
Y
32
6a
7a
6a
7a
6a
6a
7a
7a

66a

67a

93a

94a

96a

98a

METHOD AND APPARATUS FOR PRODUCING AND CONTROLLING THE PRODUCTION OF COMPOSITE FILTER PLUGS

BACKGROUND OF THE INVENTION

The present invention relates to a method and apparatus for the production of composite filter plugs which can be used in the manufacture of filter cigarettes, cigars or cigarillos. The invention also relates to a method and means for controlling the production of composite filter plugs of the type wherein a tubular wrapper consisting of cigarette paper, imitation cork or other suitable flexible wrapping material surrounds two or more different filter rod sections.

Composite filter plugs are produced in apparatus wherein an assembling unit forms a continuous rod-like filler consisting of alternating filter rod sections of two or more different types. The filler is moved lengthwise and is wrapped into a web of cigarette paper or the like to form with the web a continuous filter rod which is severed by a cutoff to yield a file of discrete composite filter plugs each of which contains at least a portion of one or more filter rod sections of each type. For example, a composite filter plug may contain a centrally located first filter rod section of double unit length which consists of acetate fibers and two second filter rod sections of unit length which flank the centrally located first section and consist of acetate fibers interspersed with charcoal, crepe paper or other suitable filter material. Such filter plugs are thereupon assembled with pairs of plain cigarettes of unit length to form therewith filter cigarettes of double unit length wherein the filter plug is located midway between two plain cigarettes of unit length. Each filter cigarette of double unit length is thereupon severed midway across its filter plug to yield two filter cigarettes of unit length each of which includes a plain cigarette of unit length and a relatively short filter plug containing one-half of the respective first filter rod section and one of the respective second filter rod sections.

A drawback of presently known apparatus for the production of composite filter plugs is that the cutoff does not and cannot invariably sever the filter rod in such a way that the composition of each and every filter plug is the same. Thus, it can happen that the first filter rod section is not located exactly midway between the two second filter rod sections, i.e., that the length of one second filter rod section exceeds the length of the other second filter rod section and the filter plug further contains a portion of an additional first filter rod section. Such filter plugs are considered defective and, if detected, must be segregated from satisfactory filter plugs prior to introduction into a machine for the manufacture of filter cigarettes.

Similar but less serious problems arise in machines for the production of plain cigarettes wherein certain portions of the rod-like tobacco filler contain more tobacco than the others, e.g., wherein the ends of the filler contain more tobacco (and are denser) than the median portion of the filler. The cutoff must sever the cigarette rod midway across each densified filler portion to thereby insure that both ends of the filler in each and every cigarette will contain more tabacco than the central portion of the filler. As a rule, the means for monitoring successive densified portions of the filler comprises a detector including a source of corpuscular radiation, e.g., a beta ray detector. Reference may be had to U.S. Pat. No. 3,604,430 which further mentions the possibility of resorting to a capacitive detector. The proposal to use capacitive detectors in connection with cigarette rods wherein filler portions of greater density alternate with much longer filler portions of lesser density is considered to be promising because the detector must monitor a single type of material (tobacco) and also because the length of filler portions of lesser density normally greatly exceeds the length of filler portions of greater density. The length of the last mentioned filler portions is normally in the range of 10–12 millimeters. Moreover, the measurements need not be overly accurate because it is of no consequence whether or not the cutoff severs the filler exactly midway across successive portions of greater density. In fact, deviations amounting to 1–2 millimeters are quite acceptable in the manufacture of so-called dense end cigarettes. All the counts is to insure that the cutoff will sever the filler somewhere across the portions of greater density. The beta ray detector can be connected with a threshold circuit which transmits signals for effecting a change of the locus where the filler is severed when the intensity of signals received from the output of the detector exceeds a predetermined value. Such circuitry is incapable of insuring that the filler will be severed exactly midway across the portions of greater density; however, and as mentioned above, the accuracy is sufficient for the production of satisfactory or acceptable dense end cigarettes.

The situation is quite different in the production of composite filter plugs. First of all, various filter rod sections of the filler in a filter rod which is to be subdivided into composite filter plugs exhibit different dielectric constants. Secondly, the filter rod sections of the composite filler are very short so that a capacitive detector of finite length is not expected to furnish signals with a degree of reliability which is necessary to insure that each and every filter plug of a series of composite filter plugs will be identical with all other filter plugs. Otherwise stated, the aforementioned proposal in U.S. Pat. No. 3,604,430 (to use a capacitive detector as a substitute for a beta ray detector) does not allow for accurate determination of loci where a filter rod containing a composite rod-like filler should be severed by a cutoff in order to yield a succession of identical composite filter plugs. This is due to the fact that a capacitive detector is incapable of detecting the exact center of successive filter rod sections in the filler and/or the exact location of that region where two neighboring filter rod sections which consist of different filter materials abut each other. It is further known that signals furnished by a capacitive detector which is connected to a high-frequency source exhibit a tendency to drift; this phenomenon is another reason why a capacitive detector was considered to be impractical for use as a means for monitoring the constituents of the filler in a filter rod which is to be subdivided into composite filter plugs. In accordance with heretofore known proposals, the filler of such filter rod is monitored by a photoelectric detector which, however, is only suitable for the monitoring of so-called recessed filter plugs because the light beam issuing from the light source of the detector can pass through the gap between two spaced-apart sections of the filter plug. Such proposals failed to gain acceptance in the industry because the intensity of the light beam decreases considerably during passage through the wrapper of the filter plug so that the detector must utilize an extremely sensitive photoelectric transducer which is prone to malfunction, e.g., because it reacts immediately to the presence of minute solid particles, such as tobacco dust. Furthermore, the just discussed recessed filter plugs are not overly popular, i.e., filter cigarettes using such plugs consitute but a small percentage of currently produced filter cigarettes.

Photoelectric detectors are not suited for monitoring of filter rods wherein two or more different types of filter rod sections are disposed end-to-end because the transmissivity of filter rods varies very little or not at all. Therefore, certain presently known apparatus for the production of composite filter plugs employ detectors including sources of corpuscular radiation. Such detectors are reliable; however, they can be dangerous to attendants, especially to unskilled persons. Therefore, their use invariably involves a host of complex and expensive precautionary measures and, consequently, such detectors are not acceptable to many manufacturers of smokers' products. It is still prevalent to remove samples of composite filter plugs at regular or irregular intervals, to break open and visually examine the samples, and to manually adjust the apparatus if the examination of samples reveals deviations from an optimum composition. Such procedure is costly, time consuming and cannot prevent the manufacture of large quantities of unacceptable composite filter plugs.

SUMMARY OF THE INVENTION

An object of the invention is to provide a novel and improved method and apparatus for producing, and simultaneously controlling the production of, composite filter plugs in such a way that adjustments, if any, are effected automatically, that the constituents of filter plugs can be monitored in a manner which does not present any danger to attendants, and that the composition of all or nearly all mass-produced filter plugs conforms to a desired norm.

Another object of the invention is to provide a novel and improved method and means for controlling the operation of apparatus for mass-production of composite filter plugs wherein the filler contains two or more different filter rod sections which are disposed end-to-end.

A further object of the invention is to provide control means which can be installed in existing apparatus for the production of composite filter plugs as a superior substitute for presently known control means (if any) and which can be readily adjusted to allow for severing of a continuous filter rod at desired intervals with more or less pronounced tolerances.

An additional object of the invention is to provide a filter plug making apparatus which embodies the above outlined control means and which can be used for mass-production of a variety of composite filter plugs.

Still another object of the invention is to provide control means which need not utilize photoelectric detectors and/or detectors including sources of corpuscular radiation but is nevertheless capable of reliably monitoring the constituents of the filler prior, during or subsequent to conversion into a filter rod which is ready to be subdivided into composite filter plugs.

One feature of the invention resides in the provision of a method of producing and controlling the production of composite filter plugs for use in the manufacture of filter cigarettes, cigars or cigarillos. The method comprises the steps of assembling a continuous rod-like filler consisting of at least two types of alternating filter rod sections which are normally disposed end-to-end (i.e., without any gaps between neighboring sections of different types), conveying the filler along a predetermined path (e.g., along a substantially horizontal path above the upper stretch of the garniture in a filter rod making machine), draping the filler into a continuous web of cigarette paper, imitation cork or other suitable flexible wrapping material in a first portion of the path to form a continuous filter rod wherein the web forms a tubular wrapper surrounding the rod-like filler, severing the rod in a second portion of the path so that the rod yields a file of discrete composite filter plugs each of which normally contains at least a portion of at least one section of each of the several types of sections (e.g., the wrapper of a composite filter plug may contain a centrally located first filter rod section of double unit length and two second filter rod sections of unit length whereby the second sections flank and abut against the respective ends of the first section), establishing a high-frequency electric field at least a portion of which is traversed by successive sections in the aforementioned path whereby a characteristic of the field changes to a different extent in response to traversal of the field by sections of different types (the field can be established by a capacitive detector having at least two plates or electrodes adjacent to the path for the filter rod sections and constituting the frequency-determining elements of a resonant circuit, and a high-frequency source connected to the electrodes), producing a series of signals which are indicative of changes of the aforementioned characteristic of the high-frequency field (the output of the capacitive detector can transmit such signals to a suitable evaluating circuit), and comparing the signals with a reference signal (such comparison can be effected by a phase comparing circuit which receives reference signals from a pulse generator having a rotary element or component driven in synchronism with the cutoff which is used to sever the filter rod and/or by one or more counters, threshold circuits or analogous signal comparing means which receive reference signals from pulse generators, rated value selectors or the like).

The signals of the series may include a sequence of first signals of maximum intensity which are indicative of traversal of the high-frequency field by sections of a first type, a sequence of second signals of minimum intensity which are indicative of traversal of the high-frequency field by sections of a second type, and a sequence of third signals of intermediate intensity which are indicative of traversal of the high-frequency field by the ends of neighboring sections of different types. The method may further comprise the steps of timing the occurrence of successive signals of one of the first and second sequences by a suitable switching circuit and producing additional signals in response to occurrence of successive signals of the one sequence. Such signals can be used to regulate the speed of lengthwise movement of the filler, web and filter rod. The signals of the aforementioned series normally form a continuous signal flow and timing step may comprise continuously differentiating the signal flow. The last mentioned signal producing step then comprises producing an additional signal when the intensity of the differentiated signal flow exceeds a predetermined value (this can be achieved by resorting to a suitable threshold circuit).

The severing step preferably comprises severing the filter rod at a variable frequency, and the method then further comprises the step of generating the reference signals at a frequency which varies with the severing frequency. This can be achieved by synchronizing the speed of a rotary element of a pulse shaper which furnishes reference signals with the speed of one of or more rotary components of the cutoff for the filter rod.

The comparing step may comprise determining the relationship of phases of the signals of the aforementioned series and the reference signal and producing an additional signal when the reference signal is out of phase with a signal of the series. The method then further comprises the step of utilizing the additional signals for synchronization of the frequency of severing step with the speed of conveying the filter rod sections, the composite filler, the web and the filter rod along the aforementioned path. The step of producing additional signals is preferably interrupted in response to detected absence of a filter rod section in the path.

The method may comprise the additional step of repeatedly differentiating the aforementioned continuous signal flow; the comparing step then comprises comparing a characteristic of the reference signal with the corresponding characteristic of signals represented by the differentiated signal flow.

The method may further comprise the step of removing the corresponding filter plug or plugs from the path in response to detected absence of a filter rod section in the filler.

The method may also comprise the steps of timing the occurrence of aforementioned third signals of intermediate intensity and producing further signals in response to occurrence of each third signal of intermediate intensity. The timing step comprises repeated differentiation of the signal flow, and the last mentioned signal producing step comprises comparing the differentiated signal flow with a reference signal and producing a further signal when the intensity of a signal of the signal flow exceeds the intensity of the last mentioned reference signal.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

Figure 1:
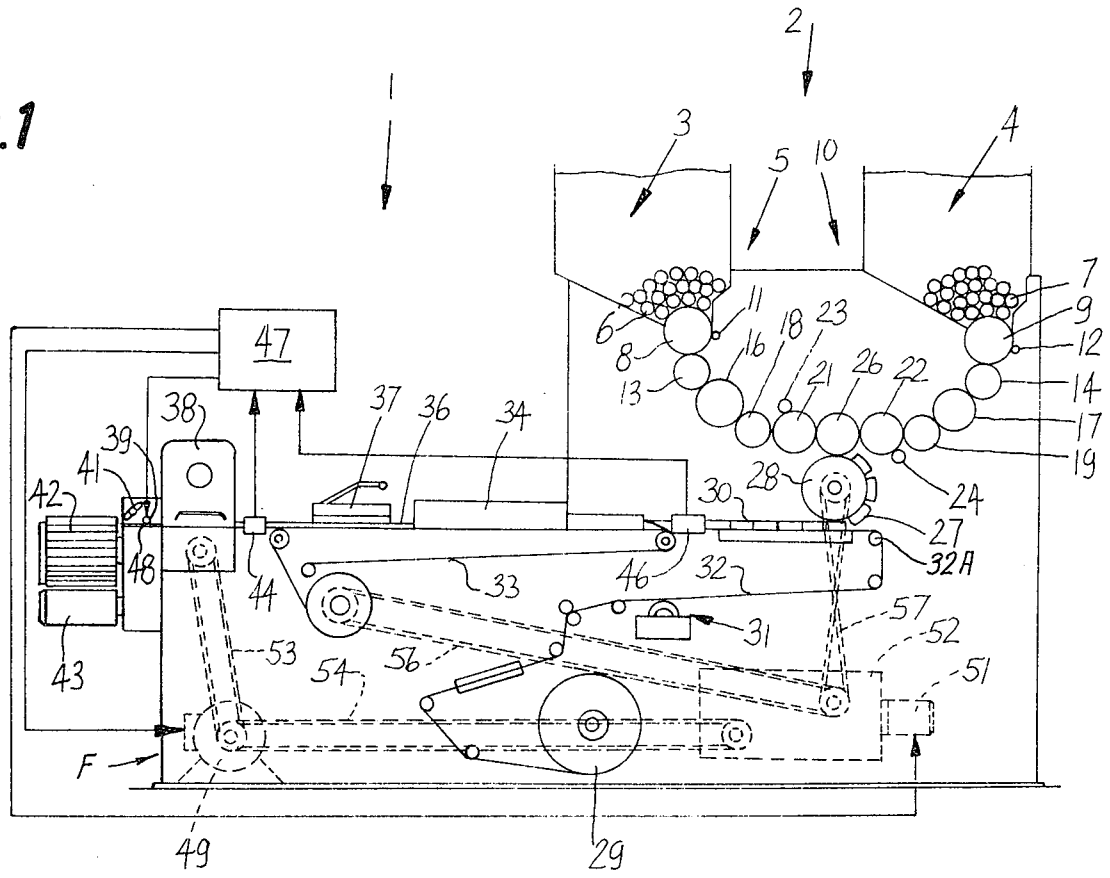
FIG. 1 is a diagrammatic elevational view of an apparatus which embodies the invention.

FIG. *3a* is a longitudinal sectional view of a portion of the filter rod which is produced in the apparatus of FIG. 1;

FIGS. *3b, 3c, 3d, 3e* and *3f* are diagrammatic representations of curves illustrating the flow of signals from certain components which form part of the control means and serve to insure satisfactory operation of severing means for the filter rod;

FIG. *4a* illustrates the structure of FIG. *3a;* and

FIGS. *4b, 4c, 4d, 4e, 4f* and *4g* illustrate curves representing the flow of signals from certain components of the control means which detect the absence of filter rod sections in the filler.

DESCRIPTION OF THE PREFERRED EMBODIMENTS

The apparatus of FIG. 1 comprises two main units, namely an assembling unit 2 which serves to form a continuous filler 30 consisting of alternating filter rod sections of two different types and a filter rod making machine or unit 1 which converts the filler 30 and a web 32 of cigarette paper, imitation cork or other suitable flexible wrapping material into a continuous filter rod 36. The unit 1 further comprises a cutoff 38 or analogous severing means which subdivides the rod 36 into a file of discrete filter plugs 39 each of which contains at least a portion of a filter rod section of each type.

The assembling unit 2 comprises two magazines or hoppers 3, 4, a rotary drum-shaped assembly conveyor 26, a transfer conveyor 28 which delivers groups of filter rod sections from the assembly conveyor 26 onto the adjacent portion of the web 32, and two sets of conveyors indicated at 5 and 10 which respectively manipulate and transport filter rod sections 6, 7 from the magazines 3, 4 to the assembly conveyor 26. The filter rod sections 6 are different from the filter rod sections 7. For example, the fillers of the filter rod sections 6 may consist exclusively of fibrous filamentary filter material (e.g., acetate fibers) and the fillers of filter rod sections 7 may consist of crepe paper or a fibrous filamentary material interspersed with particles of activated charcoal or the like.

The conveyors 5 include a rotary drum-shaped withdrawing conveyor 8 a portion of which extends into the outlet of the magazine 3 and which has peripheral receiving means in the form of flutes serving to transport discrete filter rod sections 6 sideways past a rotary disk-shaped knife 11. The latter severs each section 6 midway between its ends to form a pair of coaxial shorter sections. For example, each section 6 may be of eight times unit length, and each shorter section is then of four times unit length. The conveyor 8 delivers pairs of coaxial shorter sections to a rotary staggering conveyor 13 which comprises two drums rotating at different speeds of transporting the respective shorter sections through different distances so that one shorter section of each pair is staggered with respect to the other shorter section of the respective pair, as considered in the circumferential direction of the conveyor 13, before the thus staggered shorter sections are transferred into successive flutes of a rotary drum-shaped shuffling conveyor 16. The conveyor 16 cooperates with one or more stationary cams (not shown) which cause some or all of the shorter sections to move axially (at right angles to the plane of FIG. 1) so that the thus shifted shorter sections form a single row wherein each preceding section is in exact register with the next-following section. The flutes of the shuffling conveyor 16 transfer successive shorter sections into successive flutes of a rapidly rotating drum-shaped accelerating conveyor 18. The distance between successive flutes of the conveyor 18 exceeds the distance between successive flutes of the shuffling conveyor 16. The conveyor 18 delivers shorter filter rod sections into successive flutes of a rotary drum-shaped severing conveyor 21 which cooperates with a rotary disk-shaped knife 23 to subdivide each shorter section into two coaxial sections *6a* (see FIGS. *3a* and *4a*) of two times unit length. The severing conveyor 21 further cooperates with a wedge-like cam or other suitable means for moving the sections *6a* of each pair axially and away from each other (i.e., at right angles to the plane of FIG. 1) so that the sections 6a are separated from each other by a clearance or gap having a width exceeding the length of a filter rod section 7a (see FIGS. 3a and 4a) of two times unit length. The thus separated pairs of filter rod sections 6a are thereupon transferred into seccessive flutes of the assembly conveyor 26.

The conveyors of the set 10 are substantially identical with conveyors of the set 5. The conveyors 9, 14, 17, 19, 22 of the set 10 perform functions which are respectively identical with those of the conveyors 8, 13, 16, 18, 21, and the knives 12, 24 are respectively functional equivalents of knives 11 and 23. Of course, the conveyors 9, 14, 17, 19 and 22 manipulate the sections 7 so that each flute of the assembly conveyor 26 receives two spaced-apart filter rod sections 7a of double unit length. The sections 7a in the flutes of the assembly conveyor 26 alternate with the sections 6a. The sections 6a, 7a in each flute of the conveyor 26 form a group 27.

Successive groups 27 are taken over by the transfer conveyor 28 which constitutes a turn-around device because it changes the orientation of successive groups 27 by 90° prior to deposition of such groups on the adhesive-coated upper side of the running web 32. The conveyor 28 transfers the groups 27 in such a way that the neighboring sections 6a, 7a of the rod-like filler 30 abut against each other, i.e., that the neighboring sections 6a, 7a are normally disposed end-to-end without any gaps therebetween.

The web 32 is withdrawn from a roll 29 which is rotatable in or on the frame F of the machine 1. One side of the web 29 is coated with adhesive during travel along a paster 31, and the web thereupon travels around a guide roller 32A which causes the adhesive-coated side to face upwardly in the region below the transfer conveyor 28. The adhesive insures that the sections 6a, 7a of the filler 30 cannot move axially or otherwise with respect to each other. Furthermore, such adhesive coats one marginal portion of the web 32 before the latter enters a wrapping mechanism 34 of the machine 1. The mechanism 34 drapes the web 32 around the filler 30 so that the web is converted into a tubular wrapper the aforementioned marginal portion of which overlies the other marginal portion to form therewith a seam extending lengthwise of the resulting filter rod 36. The seam is thereupon heated or cooled by a sealer 37 (depending upon whether the adhesive applied by the paster 31 is a so-called wet or cold adhesive which sets in response to heating or a heat-activatable adhesive, known as hotmelt, which sets in response to cooling). The means for drawing the web 32 off the roll 29 and for transporting the web through and beyond the wrapping mechanism 34 comprises an endless belt conveyor 33 known as garniture. The rod 36 is severed at regular intervals by the cutoff 38 to yield a single file of discrete composite filter plugs 39 of predetermined length, e.g., double unit length. Successive filter plugs 39 are accelerated by a rapidly rotating cam 41 which propels them into successive flutes of a rotary drum-shaped row forming conveyor 42. The conveyor 42 converts the single file of filter plugs 39 into one or more rows wherein the filter plugs travel sideways and are deposited on the upper reach of a belt or chain conveyor 43 which transports the filter plugs to a further processing station, e.g., to the assembly conveyor of a filter cigarette making machine, not shown.

The cutoff 38 is preceded by a first capacitive detector 44 which monitors the rod 36 downstream of the sealer 37. The dimensions of the electrodes 62, 63 (see FIG. 2) of the detector 44 can be selected empirically in such a way that their length, as considered in the direction of lengthwise movement of the rod 36 along a preferably horizontal path, is related to the length of discrete filter rod sections 6a, 7a in the tubular wrapper of the rod. The output of the detector 44 produces signals whose intensity or another characteristic (hereinafter referred to as intensity) varies gradually (i.e., at a relatively low speed) depending upon whether the adjacent portion of the path for the rod 36 contains a section 6a or a section 7a. Empirical determination of the optimum length of electrodes 62, 63 is preferred at this time so as to enable the designer to take into consideration the nature (composition) and length of the sections 6a, 7a.

A second detector 46 serves to monitor the unwrapped filler 30 and, therefore, this detector is installed upstream of the wrapping mechanism 34. The detector 46 may be a capacitive detector (see the electrodes 118, 119 at the top of FIG. 2), and its electrodes are long enough (as considered in the direction of lengthwise movement of the filler 30) to detect the absence of one or a series of two or more filter rod sections 6a and/or 7a. It is assumed that the length of electrodes 118, 119 is selected with a view to detect the absence of several successive sections 6a or 7a.

The detectors 44 and 46 form part of and transmit signals to other elements of a control circuit 47 which has outputs for transmission of signals to various components of the apparatus. One output of the control circuit 47 is connected with an ejector nozzle 48 which is installed between the cutoff 38 and the accelerating cam 41 and serves to expel defective filter plugs 39 upstream of the row forming conveyor 42. Another output of the control circuit 47 is connected to a main prime mover 49 of the apparatus, and a third output of the control circuit 47 is connected to a servomotor 51 for an infinitely variable-speed transmission 52 which drives the transfer conveyor 28 and the garniture 33, i.e., the means for conveying the sections 6a, 7a of the filler along the aforementioned path. The main prime mover 49 (e.g., a variable-speed electric motor) operates the mobile parts of the cutoff 38 and drives the input element of the transmission 52. The means for transmitting torque from the main prime mover 49 to the cutoff 38 and transmission 52 comprises belt or chain drives 53, 54, and the means for transmitting torque from the output element of the transmission 52 to the garniture 33 and conveyor 28 comprises chain or belt drives 56, 57. The main prime mover 49 further drives all other mobile parts of the apparatus, such as the conveyors of the unit 2, the conveyor 42 and/or 43, and many others. It is normally preferred to provide a separate prime mover for the knives 11, 12, 23, 24 and the grinding wheels for such knives. It will be noted that the cutoff 38 receives torque directly from the main prime mover 49 and that the means for conveying the filter rod sections, the filler, the web and the filter rod receive motion indirectly, i.e., by way of the transmission 52. This renders it possible to change the speed of the components of the filter rod 36 independently of the frequency at which the cutoff 38 severs the rod 36, or vice versa.

Figure 2:
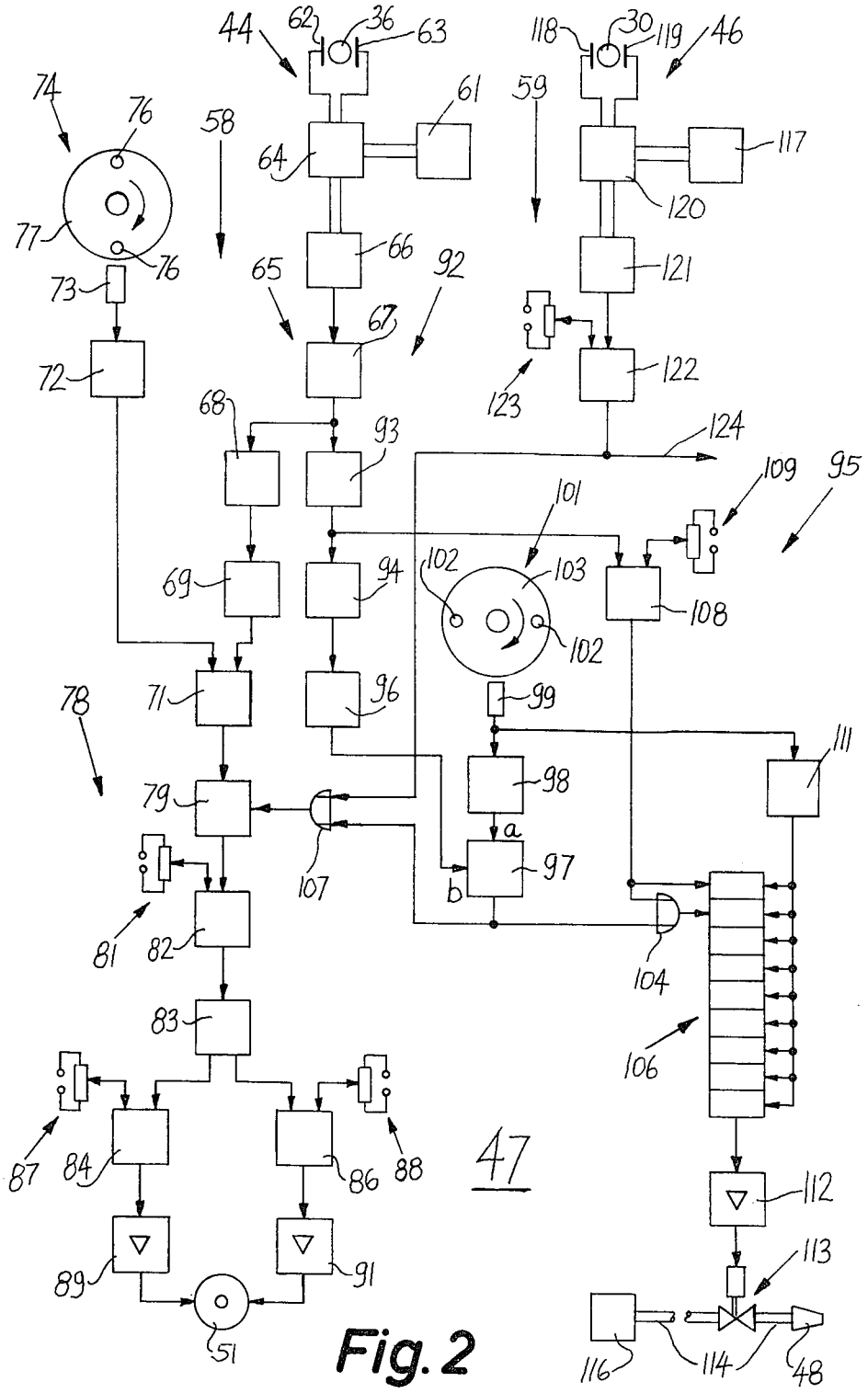
FIG. 2 is a circuit diagram of control means in the apparatus of FIG. 1.

The elements of the control circuit 47 are shown in FIG. 2. This circuit has two branches including a branch 58 which monitors and controls the locus where the filter rod 36 is severed by the cutoff 38, and a branch 59 which detects the absence of filter rod sections.

The branch 58 includes the detector 44 wherein a source 61 of high-frequency voltage is connected to the electrodes 62, 63. These electrodes constitute the frequency-determining elements of an oscillator 64. The electrodes 62, 63 receive high voltage of constant frequency which is stabilized by a quartz crystal. An oscillator which can be used in the detector 44 is described on page 507 in the 1967 edition of RCA-Transistor Manual published by the Radio Corporation of America. The output of the oscillator 64 is connected with an evaluating circuit 66 whose output transmits a continuous series of signals (see the curve 66*a* in FIG. 3*b* or 4*b*) indicative of the amplitude of an electrical value (current or voltage) of the oscillator output signals. The amplitude is dependent on the nature of that portion of the filter rod 36 which traverses some or all of the field lines between the electrodes 62 and 63. In the embodiment of FIGS. 1 and 2, the electrodes 62, 63 are disposed at the opposite sides of the path for the filter rod 36; however, they can also be mounted at one side of the path to constitute a so-called stray field capacitor.

The output of the evaluating circuit 66 is connected with a first switching circuit 65 which determines the timing of maximum and minimum intensity signals in the signal flow from the output of the circuit 66. The switching circuit 65 comprises a first differentiating circuit 67 which is followed by a threshold circuit 68. The latter is connected with one input of a phase comparing circuit 71 by way of a pulse shaper 69. Another input of the circuit 71 is connected with the proximity switch 73 of a pulse generator 74 by way of a pulse shaper 72. The pulse generator 74 further comprises a disk or an analogous rotary element 77 having projections 76 which travel past the switch 73 whereby the latter transmits reference signals in response to passage of successive projections. The phase comparing circuit 71 may constitute a so-called flank-regulated digital storage which reacts only to positive flanks of signals at the signal admitting and comparing inputs. A circuit which can be used in the switching circuit 65 as a phase comparing means is disclosed on pages 22 et seq. of the German-language publication "Elektronik-Praxis" (No. 10, October 1973).

The disk 77 of the pulse generator 74 is driven in synchronism with the orbiting knife of knives of the cutoff 38 in such a way that the switch 73 transmits a reference signal at the same frequency at which the cutoff severs the rod 36. The circuit 71 is connected with an adjusting circuit 78 which serves to synchronize the operation of conveyors for the sections 6*a,* 7*a* with that of the cutoff 38. The adjusting circuit 78 comprises a signal storing circuit 79 one input of which is connected to the output of the phase comparing circuit 71 and the output of which is connected to a signal comparing junction 82. The latter is further connected with a rated value selector 81 (e.g., an adjustable potentiometer) and its output transmits signals to an averaging circuit 83. The two outputs of the averaging circuit 83 are connected to discrete junctions 84 and 86. These junctions have additional inputs which are respectively connected with rated value selectors 87, 88. The outputs on the junctions 84, 86 are connected with the servomotor 51 for the transmission 52 by way of discrete amplifiers 89, 91. The junction 84 transmits a signal when the intensity of output signal from the averaging circuit 83 exceeds a predetermined positive value. The junction 86 transmits a signal when the intensity of output signal from the averaging circuit 83 is below a predetermined minimum value. These junctions can cause the motor 51 to rotate in the one or the other direction and to thus increase or reduce the speed ratio of the transmission 52.

The output signal from the first differentiating circuit 67 is further transmitted to a second differentiating circuit 93 forming part of a second switching circuit 92 whose function is to determine the timing of turning points (signals of intermediate intensity) between maximum and minimum intensity signals in the signal flow from the evaluating circuit 66. The output of the second differentiating circuit 93 is connected with a pulse shaper 96 by way of a threshold circuit 94. The pulse shaper 96 is connected with the erasing input *b* of a second comparing circuit 97 here shown as a counter forming part of a monitoring circuit 95. The counter 97 detects the absence of those filter rod sections which cause the generation of maximum intensity signals in the signal flow from the evaluating circuit 66 to the differentiating circuit 67. The input *a* of the counter 97 is connected with a proximity switch 99 by way of a pulse shaper 98. The switch 99 forms part of a pulse generator 101 having a rotary disk or an analogous rotary element 103 with projections 102 analogous to the projections 76 of the disk 77. The disks 77 and 103 can be mounted on a common shaft and the angular position of the disk 103 can be selected in such a way that the switch 99 transmits to the pulse shaper 98 a reference signal whenever a filter rod section 6*a* or 7*a* (whichever of these is to be monitored) is located midway between the electrodes 62 and 63 of the detector 44. The counter 97 is reset to zero whenever its input *b* receives a signal from the pulse shaper 96. The output of the counter 97 transmits a signal in response to transmission of two successive signals to its input *a;* such output signal is transmitted to one input of a first OR-gate 104 which is connected with the second stage of a shift register 106 and with one input of a second OR-gate 107 which is connected to an input of the signal storing circuit 79. The arrangement is such that the circuit 79 does not accept a signal from the phase comparing circuit 71 when its right-hand input receives a signal from the OR-gate 107.

No phase shift in the signal flow takes place in response to detected absence of a filter rod section which causes the generation of a minimum intensity signal in the signal flow from the evaluating circuit 66. This is based on the premise that a minimum intensity signal in the signal flow will be produced in the absence of such filter rod section. Therefore, the phase comparison need not be interrupted in response to detected absence of such section. Nevertheless, the absence of such section must be detected in order to remove all filter plugs wherein one of the filter rod sections 6*a,* 7*a* is missing. To this end, the circuit 95 comprises a further signal comparing circuit 108 which can constitute a threshold circuit and is connected with a rated value selector 109. The input of the circuit 108 is connected with the second differentiating circuit 93 and the output of 108 is connected with the first stage of the shift register 106 as well as with the second stage (via OR-gate 104). The selector 109 transmits reference signals to the right-hand input of the circuit 108.

It will be noted that the control circuit 47 includes three means (71, 97, 108) for comparing signals from 44 with reference signals (furnished by 72, 98, 109).

In the embodiment of FIGS. 1 and 2, the cutoff 38 is assumed to sever the rod 36 midway across those filter rod sections (e.g., 7a) which generate minimum intensity signals in the signal flow from the evaluating circuit 66. This means that, in the absence of a section 7a in the rod 36, the apparatus turns out two defective filter plugs 39. Consequently, the control circuit 47 of FIG. 2 must furnish signals for ejection of two successive filter plugs (see the transmission of signals from the output of signal comparing threshold circuit 108 to the first and second stages of the shift register 106). The number of stages in the shift register 106 depends on the distance between the detector 44 and the ejector nozzle 48 in order to insure that a signal from 108 reaches the nozzle 48 at the exact moment when the respective defective filter plug 39 is ready to be ejected in response to admission of compressed air into the orifice or orifices of the nozzle. The number of stages in the shift register 106 equals the distance between 44 and 48 divided by the length of a filter plug 39. The stages of the shift register 106 are further connected with the proximity switch 99 by way of a pulse shaper 111 so that a signal is advanced from a preceding stage to the next-following stage in response to each signal from 99 to 111. The output of the shift register 106 is connected with the solenoid of a valve 113 by way of an amplifier 112. The valve 113 is normally closed and opens in response to energization of its solenoid. This valve is installed in a conduit 114 which connects the ejector nozzle 48 with a source 116 of compressed air or another suitable gaseous fluid.

If the control circut 47 of FIG. 2 detects the absence of several successive filter plugs 39, this normally indicates the existence of a malfunction and warrants a stoppage of the apparatus. Such stoppage is effected by the branch 59 which includes the detector 46. The detector 46 is similar to the detector 44. It comprises a source 117 of high-frequency voltage which supplies high voltage of constant frequency to the electrodes 118, 119 of the detector 46. These electrodes constitute the frequency determining component of an oscillator 120. The latter is connected with a signal comparing circuit 122 through the medium of an evaluating circuit 121. The circuit 122 receives reference signals from a rated value selector 123 and transmits signals to one input of the OR-gate 107, i.e., to the signal storing circuit 79. A conductor 124 connects the output of the circuit 122 with the main prime mover 49; this conductor transmits signals which arrest the prime mover.

FIGS. 3b to 3f show the configuration of signals which synchronize the operation of conveyors with that of the cutoff 38. FIG. 3a shows a portion of the filter rod 36 whose filler consists of alternating filter rod sections 6a and 7a. The curve 66a of FIG. 3b represents the signal flow from the output of the circuit 66, the curve 67a of FIG. 3c the signal flow from the output of the circuit 67, and the curves 68a, 69a, 73a of FIGS. 3d, 3e, 3f respectively represent the signal flow from the outputs of the circuits 68, 69, 73.

Figures 4A, 4B, 4C, 4D, 4E, 4F, 4G:
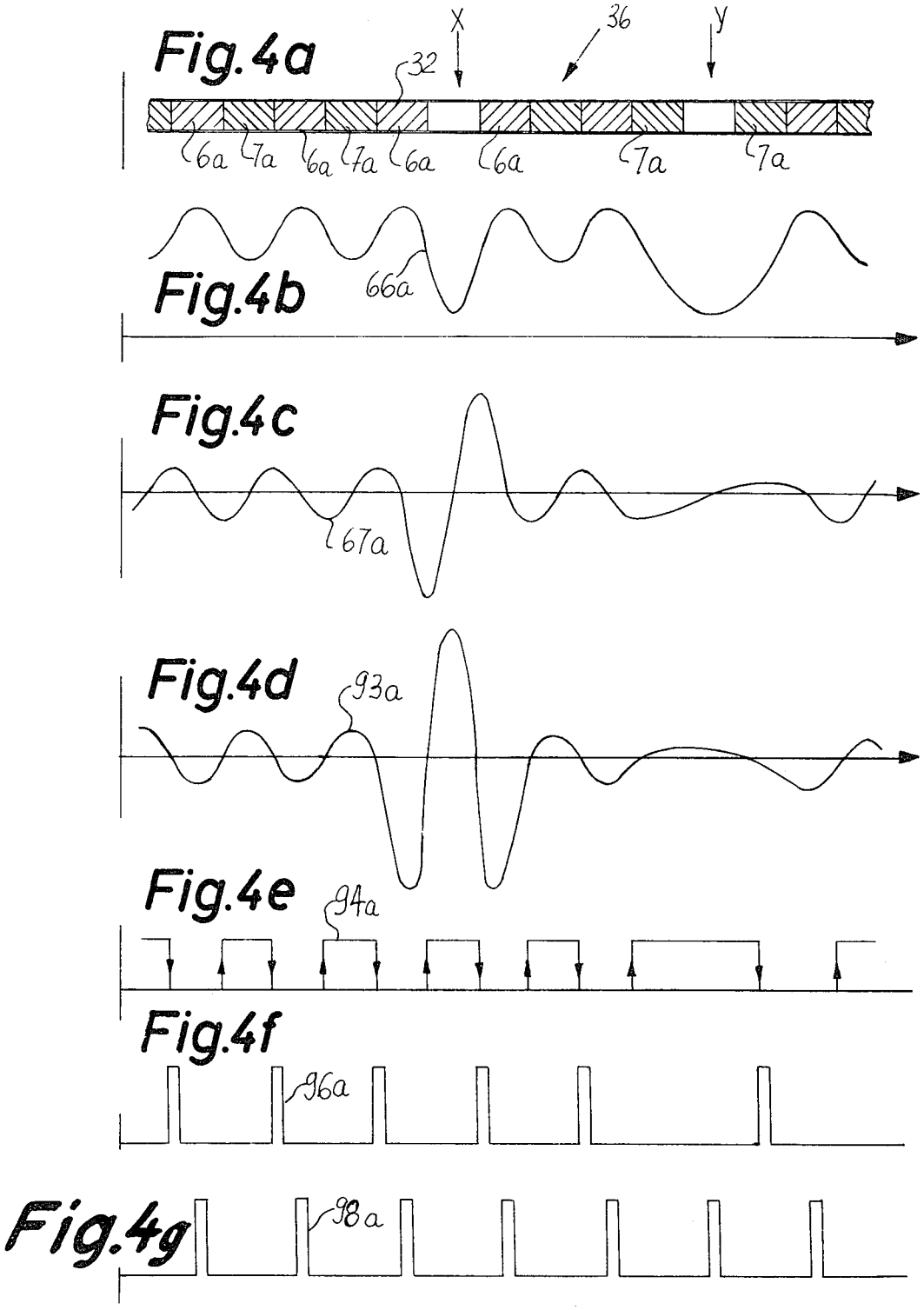

FIG. 4a again shows a portion of the filter rod 36, and the FIGS. 4b, 4c, 4d, e, 4f, 4g respectively show curves 66a, 67a, 93a, 94a, 96a, 98a representing the signal flow from the outputs of circuits 66, 67, 93, 94, 96, 98.

The curves of FIGS. 3b–3f and 4b–4g are not drawn to scale; they merely approximate the intensities of signals which are transmitted by the respective circuits.

The operation:

The synchronization of operation of cutoff 38 with the speed of conveyors for the web 32 and filter rod sections 6a, 7a will be described with reference to FIGS. 3a to 3f. The filler of the filter rod 36 of FIG. 3a is assumed to have a gap at the locus X because a filter rod section 7a is missing, and a gap at the locus Y due to the absence of a filter rod section 6a. The curve 66a of FIG. 3b represents the signal flow from the output of the evaluating circuit 66; such signal flow develops while the filter rod 36 (namely, that portion of the filter rod 36 which is shown in FIG. 3a) moves past the electrodes 62, 63 of the detector 44. This signal flow has a first signal of maximum intensity whenever the central portion of a filter rod section 6a passes between the electrodes 62, 63 and a second signal of minimum intensity when the space between the electrodes 62, 63 receives the central portion of a filter rod section 7a. The curve 66a exhibits a transition point (a third signal of intermediate intensity) in each region where a section 6a abuts a section 7a or vice versa. The absence of the section 7a at X results in the formation of a pronounced minimum in the curve 66a of FIG. 3b, and the absence of a section 6a at the locus Y of FIG. 3a results in the formation of a minimum in the region wherein, in the presence of a section 6a at X, the curve 66a would exhibit a maximum. Therefore, the curve 66a does not exhibit minima or low points in the regions corresponding to locations of those sections 7a which flank the gap at the locus Y of FIG. 3a. Otherwise stated, and if the filter rod 36 would have a section 6a at the locus Y of FIG. 3a, the curve portion between the apices A1 and A2 would resemble the curve portion between the apices A3 and A4.

The curve 67a of FIG. 3c represents the signal flow from the output of the first differentiating circuit 67. This signal flow is the first order derivative of the curve 66a as a function of time. FIG. 3d shows that the output of the threshold circuit 68 transmits a series of discrete signals. It will be seen that, when the rising portion of the curve 67a intersects the zero line, the threshold circuit 68 transmits a signal which disappears when the downwardly sloping portion of the curve 67a crosses the zero line. The pulse shaper 69 transmits signals which coincide with the rising (positive) flanks of signals represented by the curve 68a. The pulse shaper 72 transmits similar reference signals (see FIG. 3f); such signals are triggered by the pulse generator 74.

The signals represented by curves 69a and 73a are transmitted to the phase comparing circuit 71 which transmits a predetermined signal when the two phases are identical. The signal from the output of 71 is transmitted to the signal storage circuit 79 (provided that the circuit 79 does not receive a blocking signal from the OR-gate 107) which transmits the signal to the junction 82. The junction 82 compares the signal from 79 with the signal from 81 which latter is set to determine the desired phase. When, and as shown in the drawing, the signals represented by curves 69a and 73a arrive at the right time, i.e, when there is no phase shift with respect to the desired position, the output of the junction 82 does not transmit a signal. However, if a phase shift does take place (to either side of the desired position), the output of the junction 82 transmits a positive or negative differential signal to the input of the averaging circuit 83. When the intensity of such signal deviates from the intensity determined by the junctions 84, 86 (i.e., when the intensity of averaged signal exceeds that for which the junction 84 is set or is less than that of which the junction 86 is adusted), the signal from the junction 84 or 86 is amplified by the amplifier 89 or 91 and causes the servomotor 51 to adjust the speed ratio of the transmission 52 accordingly, i.e., to increase or reduce the speed ratio. The junction 84 transmits a signal to the amplifier 89 when the intensity of signal form 83 to 84 exceeds the intensity of signal which is furnished by the selector 87, and the junction 86 transmits a signal to the amplifier 91 when the intensity of signal from 83 to 86 is less than the intensity of signal from 88 to 86. Changes in the speed ratio of the transmission 52 entail corresponding changes in the relationship of speed of the conveyors for *6a, 7a,* 32, 36 to the frequency at which the cutoff 38 severs the filter rod 36. Such adjustments insure that the knife or knives of the cutoff 38 invariably sever the rod 36 midway across successive sections *6a* or *7a*, e.g., midway across successive sections *7a*. A certain tolerance is acceptable, i.e., the severing need not take place exactly midway across the sections *7a*. The range of tolerances depends on the setting of rated value selectors 87 and 88; these are preferably adjustable so that the range of tolerances can be varied within acceptable limits.

The curves of FIGS. *3b–3c*, especially those shown in FIGS. *3e* and *3f*, indicate that the absence of a filter rod section *7a* in the rod 36 does not influence the phase comparison. The situation is different in the absence of a filter rod section *6a*. A gap at Y creates the impression of a phase shift; therefore, it is necessary to suppress the phase comparison in the case of a missing section *6a* or to prevent the transmission of a differential signal which develops in response to detected absence of a section *6a*. This will be explained in connection with FIGS. *4a–4g* (with continued reference to FIGS. 1 and 2). FIGS. *4a, 4b* and *4c* are respectively identical with FIGS. *3a, 3b* and *3c*. As shown in FIG. 2, the signal from the output of the circuit 67 is transmitted to the threshold circuit 68 (see the curve *68a* of FIG. *3d*) as well as to the input of the second differentiating circuit 93. The curve *93a* of FIG. *4d* represents the totality of signals which are transmitted by the output of the circuit 93; this curve is a second order derivative (as a function of time) of the curve *66a* shown in FIG. *4b*. The curve *93a* has a peak or maximum in register with the center of the gap at the locus X of the filter rod 36 shown in FIG. *4a*. As described in connection with FIG. *3e*, the gap at X does not affect the phase comparison; nevertheless, it is necessary to eject those filter plugs 39 which flank the cut across the wrapper of the rod 36 at the locus X (because each of these filter plugs contains only one half of a filter rod section *7a*). To this end, the output of the circuit 93 transmits a signal to the circuit 108 which compares the signal with reference signal from the rated value selector 109. Since the peak of the curve *93a* in the region of the gap at the locus X is very pronounced, the circuits 108 transmits signals to the first and second stages of the shift register 106. The latter transports such signals in synchronism with movements of the two defective filter plugs 39 (these defective filter plugs contain the two filter rod sections *6a* which flank the gap at the locus X of FIG. 4) and the two defective plugs are ejected as a result of opening of the valve 113 when the defective plugs register with the ejector nozzle 48. The valve 113 can remain open during the interval which elapses while the two defective plugs move into register with the nozzle 48 or, better still, the valve 113 opens for ejection of the first defective filter plug and opens again for ejection of the next-following defective filter plug.

The signal comparing counter 97 forms part of the means for determining the absence of filter rod sections *6a* (see the locus Y in FIG. *3a* or *4a*). The threshold circuit 94 receives signals from the seconddifferentiating circuit 93 and converts the series of signals represented by curve *93a* of FIG. *4d* into a series of discrete signals *94a* shown in FIG. *4e*. The pulse shaper 96 produces discrete signals at times corresponding to the decreasing flanks of signals represented by the curve *94a*. The signals represented by the curve *96a* are transmitted to the erasing input *b* of the counter 97. The input *a* of the counter 97 receives reference signals from the pulse generator 101 by way of the pulse shaper 98. A comparison of FIGS. *4f* and *4g* indicates that, when the filter rod sections *6a* are present in the rod 36, the counter 97 is reset to zero in response to transmission of each of the series of reference signals represented by the curve *98a*. However, if a filter rod section *6a* is missing (see FIG. *4f*), the input *b* of the counter 97 fails to receive an erasing signal so that the input *a* of the counter receives two successive reference signals from the pulse shaper 98. This causes the output of the counter 97 to transmit a signal to the OR-gate 104 and thence to the second stage of the shift register 106. The signal passes on to the amplifier 112, together with the defective filter plug 39 (which does not contain a section *6a*), and the respective plug is ejected when it registers with the nozzle 48.

The signal from the output of the counter 97 is further transmitted to the OR-gate 107 and thence to the circuit 79 at the exact moment when the circuit 71 has determined the apparent phase shift due to absence of the section *6a* (see FIG. *3e*). The signal from 107 to 79 prevents the transmission of a signal from 71 to 79.

The curves of FIGS. *3b–3f* and *4b–4g* show that these curves reassume their expected configuration immediately after passage of the gap which develops in response to absence of a single filter rod section. However, if the control circuit 47 detects the absence of two or more successive filter rod sections, the detector 46 transmits a signal to the evaluating circuit 121 and the signal from the output of the circuit 121 thereupon changes (i.e., its intensity decreases). This is determined by the circuit 122 which compares the signal from 121 with the reference signal from 123 and transmits a signal to the OR-gate 107. The signal from the OR-gate 107 prevents the circuit 79 from receiving signals via circuit 71. At the same time, the circuit 122 transmits a signal via conductor 124, and such signal is used to arrest the prime mover 49 of the machine 1.

The present invention is based on the recognition that a capacitive detector is suited for monitoring a composite rod-like filler which consists of several types of alternating filter rod sections in spite of continuous fluctuations and eventual driving of the signal flow from the output of such detector. Thus, certain criteria of the signal flow can be readily evaluated to produce further and/or additional signals which can be used for ejection of defective filter plugs, for changing the frequency at which the filter rod is severed by the cutoff and/or the speed at which the filter rod sections are transported along the path wherein the sections are wrapped and the resulting filter rod severed to yield a series of discrete composite filter plugs. A control circuit using one or more capacitive detectors can be used for monitoring of rod-like fillers wherein the filter rod sections are normally disposed end-to-end (as shown in FIGS. *3a* and *4a*) and/or for monitoring of fillers wherein the sections are separated from each other by gaps, and such monitoring is not affected by the composition of filter rod sections which may consist of acetate fibers, crepe paper, acetate fibers or crepe paper interspersed with charcoal, rod-like sections consisting of charcoal or another granular or pulverulent filtering substance, and/or others.

If the control circuit 47 is to be used in an apparatus for the manufacture of recessed filter plugs wherein filter rod sections alternate with gaps, the columns of air in such gaps can be said to constitute filter rod sections of a given type. With reference to FIG. 3*a* or 4*a*, this would mean that the sections 6*a* or 7*a* can be omitted and that the thus obtained columns of air in the wrapper of the rod 36 would constitute filter rod sections of a type different from that of the sections 7*a* or 6*a*. However, the improved control circuit has been found to be particularly suited for controlling the production of composite filter plugs wherein filter rod sections consisting of two or more different filter materials are disposed end-to-end.

A phase shift which is detected by the circuit 71 of FIG. 2 can occur in response to unintended longitudinal displacement of one or more sections 6*a* and/or 7*a* with respect to the web 32 and/or vice versa. The aforementioned differentiating steps (see the circuits 67 and 93) are intended to denote mathematical differentiation as a function time. A differential calculation of first order can be resorted to for determination of the slope of a curve at a given point. If the curve exhibits a maximum or a minimum, the slope at such locus equals zero. The zero value of the slope can be determined by relatively simple electronic means so that the aforementioned reliance on a differential calculation renders it possible to properly evaluate a signal flow which is furnished by a capacitive detector and which, in the opinion of persons skilled in the art, was not suited for use in controlling the operation of apparatus which produce composite filter plugs. In fact, the control circuit 47 can furnish highly accurate measurements. All this is necessary is to properly select the dimensions of electrodes so that the capacitive detector can furnish signals which are indicative of the exact moment when the central portion of a filter rod section traverses the high-frequency field or when such field is traversed by the planes in which neighboring filter rod sections abut each other. The latter planes can be determined with a high degree of accuracy by repeated differentiation of the curve representing the signal flow from the capacitive detector and by resorting to a threshold circuit (such as that shown at 94) to transmit to the comparing means (97) only those signals whose intensity exceeds a reference value (signals furnished by 98). As known, those points of a curve where the slope changes from upward to downward or vice versa will furnish maxima or minima if the preceding differential calculation is one of the second order.

Instead of resorting to aforedescribed ejection of corresponding filter plugs on detection of a filter rod section 7*a* (which produces a minimum in the signal flow represented by curve 66*a*), one could also determine the minima of the curve 66*a* because such minima are more pronounced when a section 7*a* is missing. However, this would not constitute an optimum method because the signals which are transmitted by a capacitive detector exhibit the aforementioned tendency to drift. Therefore, it is presently preferred to differentiate the curve 66*a* and to compare the thus obtained curve with a reference signal, i.e., to compare the magnitude of signals represented by the differentiated curve with the magnitude of a reference signal. The differentiating step renders it possible to determine the slope of the curve in a selected point. As shown in FIG. 3*c* or 4*c*, each maximum or minimum of the curve 67*a* is located in register with a plane where two neighboring sections abut against each other. If a filter rod section 7*a* is missing (the cutoff 38 is supposed to sever successive sections 7*a*), the signal is produced at a time when the center of the thus obtained gap (at X) passes between the electrodes of the capacitive detector. This facilitates the processing of such signal for ejection of the corresponding filter plugs 39. As mentioned before, such processing involves a second differentiating step at 93 and monitoring of the resulting signal flow (curve 93*a* of FIG. 4*d*).

The control circuit of FIG. 2 is further suited for monitoring the location of the planes of abutment of neighboring sections 6*a*, 7*a* for the purpose of determining the plane where the rod 36 is to be severed by the cutoff 38. To this end, the connection between the pulse shaper 69 and circuit 71 must be replaced by a connection between the circuit 71 and pulse shaper 96 so that the circuit 71 can compare the signals shown in FIGS. 3*f* and 4*f*. The plane where the cutoff 38 severs the rod can be selected at will, e.g., by appropriate adjustment of the rated value selector 81.

An important advantage of the improved method and apparatus is that the capacitive detector means can automatically monitor selected characteristics of a composite filler 30 before and/or after the latter is draped in a web of wrapping material, especially as regards the locaton of gaps due to the absence of filter rod sections and the position of filter rod sections with respect to the severing plane. Furthermore, the control circuit can determine and pinpoint the loci of absence of filter rod sections in a manner which presents no danger to attendants and is sufficiently reliable to insure the detection and ejection of each unsatisfactory filter plug.

I claim:

1. In an apparatus for producing and controlling the production of composite filter plugs for use in the manufacture of filter cigarettes or the like, a combination comprising means for assembling a continuous rod-like filler consisting of at least two types of alternating filter rod sections; means for conveying said filler along a predetermined path; means for draping said filler into a continuous web of wrapping material in a first portion of said path to form a continuous filter rod; means for severing said rod in a second portion of said path so that said rod yields discrete filter plugs each of which normally contains at least a portion of at least one section of each of said types; and control means including at least one capacitive detector having a plurality of electrodes adjacent to said path intermediate said assembling means and said severing means and means for establishing between said electrodes a high-frequency electric field which is at least partially traversed by successive sections in said path whereby the output of said detector transmits a series of signals in response to movement of successive sections past said electrodes, the signals of said series together constituting a continuous signal flow including a sequence of first signals of first intensity and a sequence of second signals of second intensity which said detector respectively transmits in response to movement of first and second types of sections past said electrodes, means for comparing the signals of said series with a reference signal, means for timing the occurrence of successive signals of one of said sequences, and means for producing additional signals in response to occurrence of successive signals of said one sequence.

2. The combination of claim 1, wherein said comparing means comprises a circuit arranged to transmit signals in response to detected absence of sections in said path.

3. The combination of claim 1, wherein said control means further comprises means for monitoring said path for the absence of sections therein and means for ejecting the corresponding filter plugs downstream of said severing means in response to signals from said monitoring means.

4. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types; establishing a high-frequency electric field at least a portion of which is traversed by successive sections in said path whereby a characteristic of said field changes to a different extent in response to traversal by sections of different types; producing a series of signals indicative of the changes of said characteristic, the signals of said series including a sequence of first signals of first intensity indicative of traversal of said field by sections of a first type and a sequence of second signals of second intensity indicative of traversal of said field by sections of a second type; comparing said signals with a reference signal; timing the occurrence of successive signals of one of said sequences; and producing additional signals in response to occurrence of successive signals of said one sequence.

5. A method as defined in claim 4, further comprising the step of removing the corresponding filter plug or plugs from said path in response to detected absence of a filter rod section in said filler.

6. In an apparatus for producing and controlling the production of composite filter plugs for use in the manufacture of filter cigarettes or the like, a combination comprising means for assembling a continuous rod-like filler consisting of at least two types of alternating filter rod sections; means for conveying said filler along a predetermined path; means for draping said filler into a continuous web of wrapping material in a first portion of said path to form a continuous filter rod; means for severing said rod in a second portion of said path so that said rod yields discrete filter plugs each of which normally contains at least a portion of at least one section of each of said types; and control means including at least one capacitive detector having a plurality of electrodes adjacent to said path intermediate said assembling means and said severing mean and means for establishing between said electrodes a high-frequency electric field which is at least partially traversed by successive sections in said path whereby the output of said detector transmits a series of signals in response to movement of successive sections past said electrodes, the signals of said series together constituting a continuous signal flow including a sequence of first signals of maximum intensity and a sequence of second signals of minimum intensity which said detector respectively transmits in response to movement of first and second types of sections past said electrodes, means for comparing the signals of said series with a reference signal, and a switching circuit interposed between said detector and said comparing means and having means for timing the occurrence of successive signals of one of said sequences.

7. The combination of claim 6, wherein said timing means comprises a differentiating circuit connected with the output of said detector and a threshold circuit between said differentiating circuit and said comparing means, said threshold circuit transmitting signals to said comparing means in response to movement of one type of sections past said electrodes.

8. In an apparatus for producing and controlling the production of composite filter plugs for use in the manufacture of filter cigarettes or the like, a comination comprising means for assembling a continuous rod-like filler consisting of at least two types of alternating filter rod sections; means for conveying said filler along a predetermined path; means for draping said filler into a continuous web of wrapping material in a first portion of said path to form a continuous filter rod; means for severing said rod in a second portion of said path so that said rod yields discrete filter plugs each of which normally contains at least a portion of at least one section of each of said types; means for operating said severing means at a plurality of speeds so that said severing means can sever said rod at a varying frequency; and control means including at least one capacitive detector having a plurality of electrodes adjacent to said path intermediate said assembling means and said severing means and means for establishing between said electrodes a high-frequency electric field which is at least partially traversed by successive sections in said path whereby the output of said detector transmits a series of signals in response to movement of successive sections past said electrodes, means for comparing the signals of said series with a reference signal, and means for transmitting said reference signal to said comparing means at a frequency which varies with said first mentioned frequency.

9. The combination of claim 8, wherein said reference signal transmitting means comprises a pulse generator having a rotary component receiving torque from said operating means.

10. The combination of claim 8, wherein said comparing means comprises a phase comparing circuit.

11. The combination of claim 8, further comprising means for operating said conveying means at a plurality of speeds, said control means further comprising means for adjusting said last mentioned operating means in response to signals from said comparing means so as to synchronize the speed of said conveying means with said first mentioned frequency.

12. The combination of claim 11, wherein said control means further comprises means for monitoring said filler for the absence of filter rod sections, said monitoring means having means for deactivating said adjusting means in response to detected absence of sections.

13. The combination of claim 12, wherein said adjusting means comprises a signal storing circuit which normally receives signals from said comparing means and said monitoring means prevents the transmission of signals from said comparing means to said signal storing circuit in response to detected absence of sections in said path.

14. In an apparatus for producing and controlling the production of composite filter plugs for use in the manufacture of filter cigarettes or the like, a combination comprising means for assembling a continuous rod-like filler consisting of at least two types of alternating filter rod sections; means for conveying said filler along a predetermined path; means for draping said filler into a continuous web of wrapping material in a first portion of said path to form a continuous filter rod; means for severing said rod in a second portion of said path so that said rod yields discrete filter plugs each of which normally contains at least a portion of at least one section of each of said types; and control means including at least one capacitive detector having a plurality of electrodes adjacent to said path intermediate said assembling means and said severing means and means for establishing between said electrodes a high-frequency electric field which is at least partially traversed by successive sections in said path whereby the output of said detector transmits a series of signals in response to movement of successive sections past said electrodes, the signals of said series together constituting a continuous signal flow including first and second signals of maximum and minimum intensity which said detector respectively transmits in response to movement of first and second types of sections past said electrodes and third signals of intermediate intensity which said detector transmits when the ends of two neighboring sections move past said electrodes, means for comparing the signals of said series with a reference signal, and a switching circuit disposed intermediate said detector and said comparing means and having means for timing the occurrence of said third signals.

15. The combination of claim 14, wherein said timing means comprises a first differentiating circuit connected with the output of said detector, a second differentiating circuit receiving signals from said first differentiating circuit, and a threshold circuit connected between said second differentiating circuit and said comparing means and arranged to transmit to said comparing means fourth signals in response to transmission to third signals to said second differentiating circuit.

16. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types; establishing a high-frequency electric field at least a portion of which is traversed by successive sections in said path whereby a characteristic of said field changes to a different extent in response to traversal by sections of different types; producing a series of signals indicative of the changes of said characteristic, the signals of said series including a sequence of first signals of maximum intensity indicative of traversal of said field by sections of a first type and a sequence of second signals of minimum intensity indicative of traversal of said field by sections of a second type; comparing said signals with a reference signal; timing the occurrence of successive signals of one of said sequences; and producing additional signals in response to occurrence of successive signals of said one sequence.

17. A method as defined in claim 16, wherein said signals of said series form a continuous signal flow and said timing step comprises continuously differentiating said signal flow, said last mentioned signal producing step comprising producing an additional signal when the intensity of the differentiated signal flow exceeds a predetermined value.

18. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types; establishing a high-frequency electric field at least a portion of which is traversed by successive sections in said path whereby a characteristic of said field changes to a different extent in response to traversel by sections of different types; producing a series of signals indicative of changes of said characteristic; and comparing said signals with a reference signal, including determining the relation of phases of the signals of ssid series and said reference signal and producing an additional signal when said reference signal is out of phase with a signal of said series.

19. A method as defined in claim 18, further comprising the step of utilizing said additional signals for synchronization of the frequency of said severing step with the speed of conveying said sections along said path.

20. A method as defined in claim 18, further comprising the step of interrupting said last mentioned signal producing step in response to detected absence of a section in said path.

21. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types; establishing a high-frequency electric field at least a portion of which is traversed by successive sections in said path whereby a characteristic of said field changes to a different extent in response to traversal by sections of different types; producing a series of signals indicative of the changes of said characteristic, the signals of said series including a sequence of first signals of maximum intensity indicative of traversal of said field by sections of a first type, a sequence of second signals of minimum intensity indicative of traversal of said field by sections of a second type, and a sequence of third signals of intermediate intensity in response to traversal of said field by the ends of neighboring sections; timing the occurrence of said third signals; producing additional signals in response to occurrence of each third signal; and comparing the signals of said series with a reference signal.

22. A method as defined in claim 21, wherein said signals of said series form a continuous signal flow and said timing step comprises repeated differentiating of said signal flow, said last mentioned signal producing step comprising comparing the differentiated signal flow with a reference signal and producing an additional signal when the intensity of a signal of said flow exceeds the intensity of said last mentioned reference signal.

23. In an apparatus for producing and controlling the production of composite filter plugs for use in the manufacture of filter cigarettes of the like, a combination comprising means for assembling a continuous rod-like filler consisting of at least two types of alternating filter rod sections; means for conveying said filler along a predetermined path; means for draping said filler into a continuous web of wraping material in a first portion of said path to form a continuous filter rod; means for severing said rod in a second portion of said path so that said rod yields discrete filter plugs each of which normally contains at least a portion of at least one section of each of said types; and control means including at least one capacitive detector having a plurality of electrodes adjacent to said path intermediate said assembling means and said severing means and means for establishing between said electrodes a high-frequency electric field which is at least partially traversed by successive sections in said path whereby the output of said detector transmits a series of signals in response to movement of successive sections past said electrodes, means for comparing the signals of said series with a reference signal, said comparing means comprising a circuit arranged to transmit signals in response to detected absence of sections in said path, and a differentiating circuit between said detector and said comparing means, said circuit of said comparing means constituting a threshold circuit which is arranged to transmit signals for ejection of filter plugs obtained on severing of said rod in regions of absent sections in response to transmission of corresponding signals from said differentiating circuit.

24. In an apparatus for producing and controlling the production of composite filter plugs for use in the manufacture of filter cigarettes or the like, a combination comprising means for assembling a continuous rod-like filter consisting of at least two types of alternating filter rod sections; means for conveying said filler along a predetermined path; means for draping said filler into a continuous web of wrapping material in a first portion of said path to form a continuous filter rod; means for severing said rod in a second portion of said path so that said rod yields discrete filter plugs each of which normally contains at least a portion of at least one section of each of said types; prime mover means for said severing means and said conveying means; means for monitoring said path for the absence of several successive sections; means for arresting said prime mover means in response to signals from said monitoring means; and control means including at least one capacitive detector having a plurality of electrodes adjacent to said path intermediate said assembling means and said severing means and means for establishing between said electrodes a high-frequency electric field which is at least partially traversed by successive sections in said path whereby the output of said detector transmits a series of signals in response to movement of successive sections past said electrodes, and means for comparing the signals of said series with a reference signal.

25. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types, and severing step comprising severing said rod at a variable frequency; establishing a high-frequency electric field at least a portion of which is traversed by successive sections in said path whereby a characteristic of said field changes to a different extent in response to traversal by sections of different types; producing a series of signals indicative of the changes of said characteristic; generating a reference signal at a frequency which varies with said first mentioned frequency; and comparing the signals of said series with said reference signal.

26. A method of producing and controlling the production of composite filter plugs for use in the manufacture of filter cigarettes or the like, comprising the steps of assembling a continuous rod-like filler consisting of at least two types of alternating filter rod sections; conveying said filler along a predetermined path; draping said filler into a continuous web of wrapping material in a first portion of said path to form a continuous filter rod; severing said rod in a second portion of said path so that said rod yields discrete filter plugs each of which normally contains at least a portion of at least one section of each of said types; establishing a high-frequency electric field at least a portion of which is traversed by successive sections in said path whereby a characterisitc of said field changes to a different extent in response to traversal by sections of different types; producing a series of signals indicative of the changes of said characteristic, the signals of said series forming a continuous signal flow; continuously differentiating said continuous flow; and comparing said signals with a reference signal, including comparing a characteristic of said reference signal with the corresponding characteristics of signals represented by said differentiated signal flow.

* * * * *